United States Patent [19]

Hollweck et al.

[11] Patent Number: 4,528,541

[45] Date of Patent: Jul. 9, 1985

[54] BIMETAL CONTROLLED SNAP DISC THERMAL SWITCH

[75] Inventors: Walter Hollweck, Nuremberg; Kurt März, Zirndorf; Herbert Eschenbacher, Eckenhaidt, all of Fed. Rep. of Germany

[73] Assignee: Inter Control Hermann Köhler Elektrik GmbH & Co., Nuremberg, Fed. Rep. of Germany

[21] Appl. No.: 578,099

[22] Filed: Feb. 8, 1984

[30] Foreign Application Priority Data

Feb. 8, 1983 [DE] Fed. Rep. of Germany ..... 3304126

[51] Int. Cl.[3] ..... H01H 37/52

[52] U.S. Cl. ..... 337/354; 337/342

[58] Field of Search ..... 337/354, 62, 372, 342; 200/83 P, 153 V, 250

[56] References Cited

U.S. PATENT DOCUMENTS 3,322,915 5/1967 Johnson ..... 337/354

4,278,855 7/1981 Rossi ..... 200/67 D

*Primary Examiner*—Harold Broome

*Attorney, Agent, or Firm*—Spencer & Frank

[57] ABSTRACT

In a bimetal controlled snap disc thermal switch for controlling the heating current to an electrical heating member, the switch including: a support plate arranged to be in thermal communication with the member; a bimetal snap disc which rests against the support plate to be in thermal communication therewith and which is formed to undergo a deformation dependent on its temperature; a switch element supported in the housing and operable for controlling the heating current, the switch element having a fixed contact and a movable contact; a contact spring carrying the movable contact and mounted for pivotal movement in the direction of the deformation of the snap disc; a movement transfer member movable in the direction of deformation of the snap disc and interposed between the snap disc and the contact spring for acting on the contact spring with play to pivot the contact spring in a direction to separate the movable contact from the fixed contact in response to a deformation of the snap disc; and a compression spring bearing against the transfer member for maintaining the transfer member in operative association with the snap disc, the compression spring is made integral with the contact spring and is in the form of a tongue cut out of the contact spring body.

9 Claims, 7 Drawing Figures

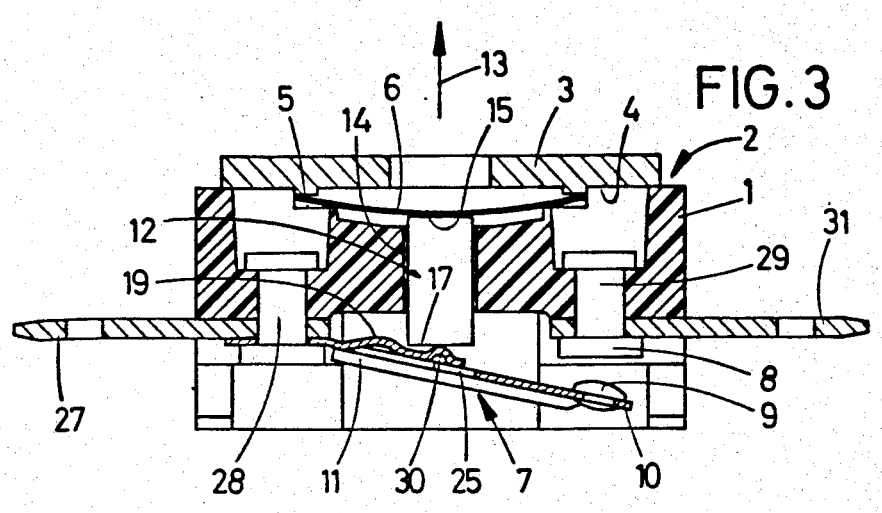
FIG. 3
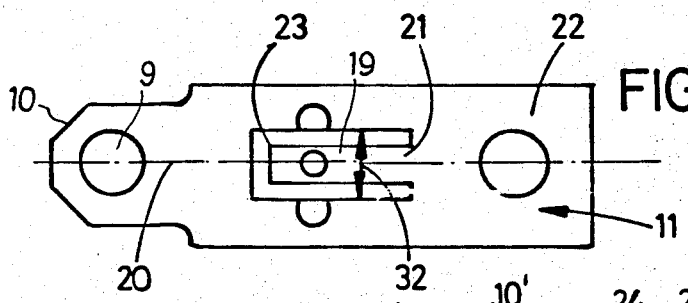
FIG. 4
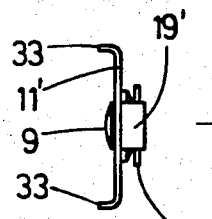
FIG. 7
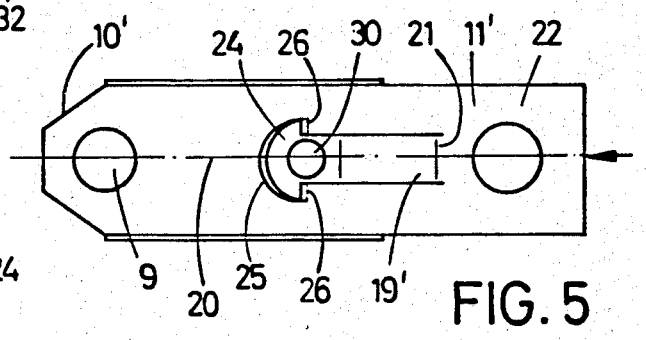
FIG. 5
FIG. 6
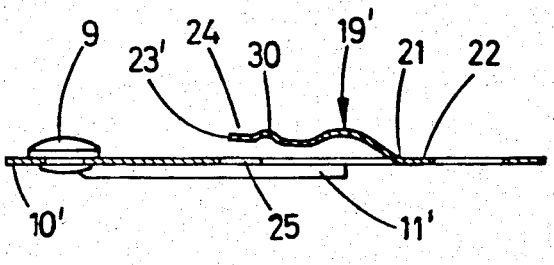

BIMETAL CONTROLLED SNAP DISC THERMAL SWITCH

BACKGROUND OF THE INVENTION

The invention relates to a bimetal controlled snap disc thermal switch of the type disclosed, for example, in German Patent Application No. 2,530,971.

Such a switch is responsive to the temperature of a heating plate, for example a surface cooking unit in a household kitchen range, and, upon reaching a certain maximum desired temperature, acts on the heating current in such a manner as to prevent further increases in the temperature of the plate. This can be done by directly interrupting the heating current by means of a switch element or reducing the heating current, or otherwise adapting that current to the desired temperature.

The bimetal snap disc in such switches is arranged so as to be in thermal contact with a support plate which itself is arranged so as to be suspended below the heating plate or a heat transfer plate of the device.

For operationally reliable performance of the bimetal snap disc it is of significance, on the one hand, that the curvature of the snap disc is able to snap over from a convex curvature at rest through the dead point, or snap point, into a concave operating curvature; on the other hand, however, the disc should remain in constant thermal contact with the support plate since only then is it assured that the bimetal curvature will react immediately with respect to the temperature of the heating plate.

It is of further significance that the first curving movement of the snap disc, when the heating plate is heated up will not be transferred directly to the electrical switch element, actuated by the snap disc by means of a transfer member, since this would result in a reduction of the switch contact pressure and possibly to disadvantageous burning of the switch contacts due to a creeping, or gradual, contact opening. For this reason, it is known to make the bimetal snap disc act on the switch element only after a certain dead time, i.e. to provide a certain amount of play in the transfer mechanism between bimetal disc and switch element. To assure now that the bimetal disc will rest in good thermal contact against the support plate in every operating position, it is also already known to transfer to the bimetal disc, via the transfer mechanism, a spring bias directed toward the base plate, and compression springs are provided for this purpose in the region of the switch.

SUMMARY OF THE INVENTION

It is an object of the present invention to provide a thermal switch which, while maintaining the thermal contact of the snap disc with respect to the support plate which is required for reliable operating behavior, is structurally simplified and, in particular, permits easy installation—possibly in an automatic manner.

The present invention specifically involves a bimetal controlled snap disc thermal switch for controlling the heating current to an electrical heating member, the switch including: a support plate arranged to be in thermal communication with the member; a bimetal snap disc which rests against the support plate to be in thermal communication therewith and which is formed to undergo a deformation dependent on its temperature; a switch element supported in the housing and operable for controlling the heating current, the switch element having a fixed contact and a movable contact; a contact spring carrying the movable contact and mounted for pivotal movement in the direction of the deformation of the snap disc; a movement transfer member movable in the direction of deformation of the snap disc and interposed between the snap disc and the contact spring for acting on the contact spring with play to pivot the contact spring in a direction to separate the movable contact from the fixed contact in response to a deformation of the snap disc; and a compression spring bearing against the transfer member for maintaining the transfer member in operative association with the snap disc. In accordance with the invention, the compression spring is integral with the contact spring and is in the form of a tongue cut out of the contact spring.

The desired easier installation is made possible because the compression spring is an integral component of the contact spring and thus can be fastened together therewith, for example with only a single rivet. Experience has shown that the installation of resilient members in housings is difficult when done in an automatic assembly line because the spring members frequently snap out of their installation position. Since no additional spring need be accommodated in the region of the switch contact, and instead the compression spring lies inside the contact spring, so to speak, the switch housing can also be given smaller dimensions so that the thermal switch can also be fitted into small, delicate housings.

In preferred embodiments of the invention, the contact spring is an elongate piece one end of which is mounted in the housing and the other end of which carries the movable contact, and the tongue extends in the longitudinal direction of the contact spring and is connected at one end to the contact spring in the vicinity of the one end of the contact spring. This limits the manufacture of the contact spring and contact tongue to a single cutting stroke and the installation of both elements (contact spring and tongue) to the insertion of only a single part into the switch housing.

In further accordance with the invention, the tongue is provided, at a location remote from its one end, with a projection which projects from the plane of the contact spring toward the transfer member. As a result, the underside of the transfer member can be made flat. Moreover, it is not necessary for the tongue to be bent upwardly out of the plane of the contact spring, except for its curvature. During the downward movement, the transfer member will initially press the tongue through the contact spring onto the underside of the contact spring and only then—after a certain desired amount of advance movement—it will actuate the contact spring itself and open the contact. Reliable loading of the contact spring results when the transfer member has the form of a cylindrical bolt with its axial direction oriented in the direction of deformation of the snap disc, with one end of the bolt being arranged to act on the contact spring and having a diameter which is greater than the width of the opening cut in the contact spring to form the tongue.

In order to prevent right from the start jamming of the tongue when it passes through the spring, the tongue is bent to be spaced from the plane of the contact spring in the direction toward the transfer member; the tongue has a portion remote from the one end thereof which is wider than a portion of the tongue adjacent the remote portion; and the tongue is further formed to cause the wider portion thereof to be pressed against associated parts of the contact spring by the transfer member when the transfer member acts to pivot the contact spring. Specifically, the tongue is bent to bring the remote portion closer to the point of connection of the tongue to the contact spring. Then, during the downward movement of the transfer member, the widened tongue portion comes to rest on the surface of the contact spring. The transfer member or the bolt, respectively, as described above, thus acts only on the tongue and the tongue acts on the contact spring.

In order to promote abrupt opening of the switch element, the contact spring is made stiffer in the region of its free end by rectangularly laterally bent portions along its longitudinal sides.

The present invention will be described in greater detail with reference to a preferred embodiment that is illustrated in the drawing.

BRIEF DESCRIPTION OF THE DRAWING

FIG. 3 is a view similar to that of FIG. 1 of the thermal switch in the open position.

FIG. 4 is a top plan view of a contact spring of the embodiment of FIGS. 1 to 3 having an integral tongue.

FIG. 5 is a view similar to that of FIG. 4 of another embodiment of a contact spring having an integral tongue, a broadened tongue end and bent portions on its sides.

FIG. 6 is a side elevational view of the contact spring of FIG. 5.

FIG. 7 is a rear end view of the contact spring of FIG. 5 seen in the direction of the arrow in FIG. 5.

DESCRIPTION OF THE PREFERRED EMBODIMENTS

Figure 1:
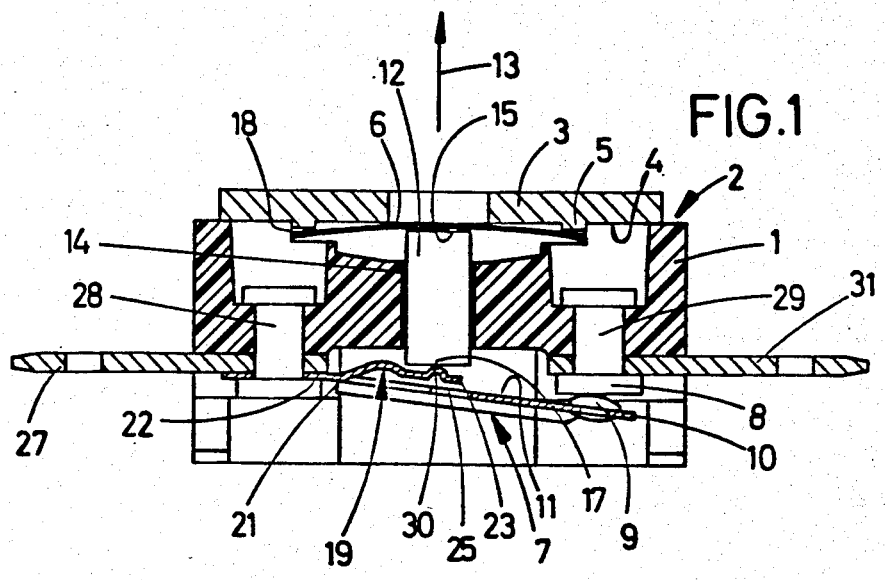
FIG. 1 is an elevational cross-sectional view of the thermal switch according to the preferred embodiment of the invention in its rest position.
Figure 2:
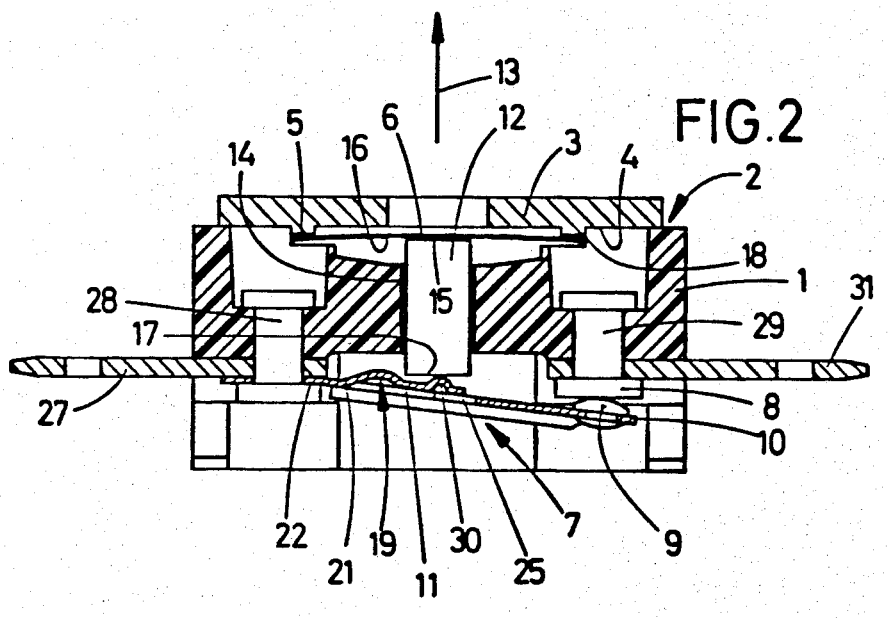
FIG. 2 is a view similar to that of FIG. 1 of the thermal switch in its position at the beginning of opening.

The thermal switch shown in FIGS. 1 to 3 essentially includes a housing 1 of electrical insulating material which is provided at its upper side 2 with a support plate 3 made of a metallic material. At its underside 4, facing the interior of the housing 1 of insulating material, support plate 3 is provided with a stamped-on support ring 5 to serve as a peripheral abutment for a round bimetal snap disc 6 which is installed in a suitable recess in the upper edge of housing 1. Support plate 3 is placed onto the housing 1 of insulating material somewhat in the manner of a metallic housing cover and serves to transfer heat from a heating plate (not shown) which, when the thermal switch is in its final installed position, is disposed on the upper side of support plate 3.

In the region of the underside of housing 1 of insulating material there is disposed an electrical switch element 7 which includes a fixed contact 8 and a movable contact 9 which is disposed at the free end 10 of a contact spring 11 that can be pivoted in the bending direction of bimetal snap disc 6.

The bending, or flexing, movement of bimetal snap disc 6 is transferred to contact spring 11 by means of a bolt-shaped transfer member 12 which is displaceably guided in a central bore 14 of housing 1, bore 14 extending in the axial direction 13. The upper end 15 of member 12 rests against the underside 16 of snap disc 6 and the lower end 17 of member 12 acts on contact spring 11. Preferably, the diameter of lower end 17 is greater than the width 32 of the opening cut in spring 11 to form tongue 19.

To assure that the edges of bimetal snap disc 6 are in thermal contact with plate 3 in every operating position of switch element 7, a compression spring is provided in the form of a tongue 19 that is cut out of contact spring 11 and presses against the underside of transfer member 12 to urge member 12 in the direction toward snap disc 6. Tongue 19 extends along the longitudinal center line 20 of contact spring 11, as shown in FIGS. 4 and 5; its fixed end 21 merges into the fastening, or mounting, end 22 of contact spring 11.

In the region of its free end 23, tongue 19 is provided with a protrusion 30 which projects from the plane of contact spring 11 toward snap disc 6 so as to provide an abutment for the lower end 17 of transfer member 12.

In the embodiment of contact spring 11' shown in FIGS. 5 to 7, the free end 23' of tongue 19' is provided with a broadened portion 24 which increases the width of the tongue with respect to its center region. A tongue which is broadened in this manner is further bent out of the plane of the contact spring in the center region of the tongue, as shown in FIG. 6, so that the broadened portion 24 is no longer congruent with the recess in the surface of the contact spring 11' from which it has been cut out, but is rather offset rearwardly along the longitudinal center line 20 in a direction toward the fastening end 22 of contact spring 11'. The result is that transfer member 12 can no longer press tongue 19' through the plane of contact spring 11', but will rather, before entering into the plane of contact spring 11', abut with edges 26 of broadened portion 24 on the surface of contact spring 11' and press it downwardly as well in the opening direction.

Contact spring 11 or 11' is fastened to the housing 1 of insulating material, together with an electrical connecting lug 27, by means of a rivet 28. A further rivet 29, which holds a further connecting lug 31 against the housing 1 of insulating material, forms fixed contact 8.

In order to promote abrupt opening of switch element 7, spring 11 or 11' is provided, at least in the region of its free end 10 or 10', with longitudinal edge portions 33 bent at right angles to the major spring portion. Edge portions 33 thus serve to stiffen the associated portion of spring 11 or 11'.

It will be understood that the above description of the present invention is susceptible to various modifications, changes and adaptations, and the same are intended to be comprehended within the meaning and range of equivalents of the appended claims.

What is claimed is:

1. In a bimetal controlled snap disc thermal switch for controlling the heating current to an electrical heating member, the switch including: a support plate arranged to be in thermal communication with the member; a bimetal snap disc which rests against the support plate to be in thermal communication therewith and which is formed to undergo a deformation dependent on its temperature; a switch element supported in the housing and operable for controlling the heating current, the switch element having a fixed contact and a movable contact; a contact spring carrying the movable contact and mounted for pivotal movement in the direction of the deformation of the snap disc; a movement transfer member movable in the direction of deformation of the snap disc and interposed between the snap disc and the contact spring for acting on the contact spring with play to pivot the contact spring in a direction to separate the movable contact from the fixed contact in response to a deformation of the snap disc; and a compression spring bearing against the transfer member for maintaining the transfer member in operative association with the snap disc, the improvement wherein said compression spring is integral with said contact spring and is in the form of a tongue cut out of said contact spring; and said transfer member has the form of a cylindrical bolt with its axial direction oriented in the direction of deformation of said snap disc, with one end of said bolt being arranged to act on said contact spring and having a diameter which is greater than the width of the opening cut in said contact spring to form said tongue.

2. A switch as defined in claim 1 wherein said contact spring is an elongate piece one end of which is mounted in said housing and the other end of which carries said movable contact, and said tongue extends in the longitudinal direction of said contact spring and is connected at one end to said contact spring in the vicinity of said one end of said contact spring.

3. A switch as defined in claim 2 wherein said tongue is provided, at a location remote from its one end, with a projection which projects from the plane of said contact spring toward said transfer member.

4. A switch as defined in claim 3 wherein: said tongue is bent to be spaced from the plane of said contact spring in the direction toward said transfer member; said tongue has a portion remote from said one end thereof which is wider than a portion of said tongue adjacent said remote portion; and said tongue is further formed to cause said wider portion thereof to be pressed against associated parts of said contact spring by said transfer member when said transfer member acts to pivot said contact spring.

5. A switch as defined in claim 2 wherein: said tongue is bent to be spaced from the plane of said contact spring in the direction toward said transfer member; said tongue has a portion remote from said one end thereof which is wider than a portion of said tongue adjacent said remote portion; and said tongue is further formed to cause said wider portion thereof to be pressed against associated parts of said contact spring by said transfer member when said transfer member acts to pivot said contact spring.

6. A switch as defined in claim 2 wherein said contact spring is provided with laterally bent portions along its longitudinal edges at least in the region of said other end of said contact spring.

7. In a bimetal controlled snap disc thermal switch for controlling the heating current to an electrical heating member, the switch including: a support plate arranged to be in thermal communication with the member; a bimetal snap disc which rests against the support plate to be in thermal communication therewith and which is formed to undergo a deformation dependent on its temperature; a switch element supported in the housing and operable for controlling the heating current, the switch element having a fixed contact and a movable contact; a contact spring carrying the movable contact and mounted for pivotal movement in the direction of the deformation of the snap disc; a movement transfer member movable in the direction of deformation of the snap disc and interposed between the snap disc and the contact spring for acting on the contact spring with play to pivot the contact spring in a direction to separate the movable contact from the fixed contact in response to a deformation of the snap disc; and a compression spring bearing against the transfer member for maintaining the transfer member in operative association with the snap disc, the improvement wherein said compression spring is integral with said contact spring and is in the form of a tongue cut out of said contact spring; said tongue is bent to be spaced from the plane of said contact spring in the direction toward said transfer member; said tongue has a portion remote from said one end thereof which is wider than a portion of said tongue adjacent said remote portion; and said tongue is further formed to cause said wider portion thereof to be pressed against associated parts of said contact spring by said transfer member when said transfer member acts to pivot said contact spring.

8. A switch as defined in claim 7 wherein said contact spring is an elongate piece one end of which is mounted in said housing and the other end of which carries said movable contact, and said tongue extends in the longitudinal direction of said contact spring and is connected at one end to said contact spring in the vicinity of said one end of said contact spring.

9. A switch as defined in claim 7 wherein said tongue is provided, at a location remote from its one end, with a projection which projects from the plane of said contact spring toward said transfer member.

* * * * *